US007946351B2

(12) United States Patent
Freyer

(10) Patent No.: US 7,946,351 B2
(45) Date of Patent: May 24, 2011

(54) METHOD AND DEVICE FOR SEALING A VOID INCOMPLETELY FILLED WITH A CAST MATERIAL

(75) Inventor: Rune Freyer, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/598,559

(22) PCT Filed: Dec. 12, 2005

(86) PCT No.: PCT/NO2005/000456

§ 371 (c)(1),
(2), (4) Date: Sep. 5, 2006

(87) PCT Pub. No.: WO2006/065144

PCT Pub. Date: Jun. 22, 2006

(65) Prior Publication Data

US 2007/0227734 A1 Oct. 4, 2007

(30) Foreign Application Priority Data

Dec. 16, 2004 (NO) ..... 20045478

(51) Int. Cl.
*E21B 33/12* (2006.01)
*E21B 33/00* (2006.01)
*E21B 33/13* (2006.01)

(52) U.S. Cl. ..... 166/387; 166/277; 166/285; 166/179

(58) Field of Classification Search ..... 166/387
See application file for complete search history.

(56) References Cited

U.S. PATENT DOCUMENTS

| | | | | |
|---|---|---|---|---|
| 2,230,626 | A * | 2/1941 | Miller | 138/145 |
| 3,099,318 | A | 7/1963 | Miller | |
| 3,385,367 | A * | 5/1968 | Kollsman | 166/191 |
| 3,387,656 | A * | 6/1968 | Guest et al. | 166/288 |
| 3,554,287 | A | 1/1971 | Eilers | |
| 3,918,523 | A * | 11/1975 | Stuber | 166/285 |

(Continued)

FOREIGN PATENT DOCUMENTS

JP 9151686 6/1997

(Continued)

OTHER PUBLICATIONS

English language abstract for JP 9151686.

(Continued)

*Primary Examiner* — Zakiya W Bates
*Assistant Examiner* — Angela M Ditrani
(74) *Attorney, Agent, or Firm* — Marlin R. Smith

(57) ABSTRACT

A method and a device for sealing a void incompletely filled with a castable material, in which an expandable material is placed in the void which is to be filled with the castable material, the expandable material expanding into spaces which are not filled with cast material. A method of sealing an annulus in a borehole includes the steps of: positioning an expandable material on a tubular structure; installing the tubular structure in the borehole, the annulus being formed between the tubular structure and the borehole; flowing a castable material into the annulus, the castable material partially displacing a fluid in the annulus, but leaving at least one space containing the fluid in the annulus; and expanding the expandable material into the space.

20 Claims, 3 Drawing Sheets

U.S. PATENT DOCUMENTS

| | | | | | |
|---|---|---|---|---|---|
| 4,137,970 | A | | 2/1979 | Laflin | |
| 4,714,117 | A | | 12/1987 | Dech | |
| 4,716,965 | A | * | 1/1988 | Bol et al. | 166/292 |
| 4,936,386 | A | * | 6/1990 | Colangelo | 166/292 |
| 5,048,605 | A | | 9/1991 | Toon | |
| 5,188,176 | A | | 2/1993 | Carpenter | |
| 5,195,583 | A | | 3/1993 | Toon | |
| 5,211,238 | A | | 5/1993 | Carpenter | |
| 5,402,849 | A | | 4/1995 | Jennings | |
| 5,476,142 | A | | 12/1995 | Kajita | |
| 5,657,822 | A | | 8/1997 | James et al. | |
| 5,810,085 | A | | 9/1998 | James | |
| 5,942,031 | A | | 8/1999 | Cheung | |
| 6,102,119 | A | * | 8/2000 | Raines | 166/244.1 |
| H1932 | H | * | 1/2001 | Heathman et al. | 166/250.14 |
| 6,848,505 | B2 | | 2/2005 | Richard | |
| 7,059,415 | B2 | | 6/2006 | Bosma | |
| 7,066,259 | B2 | * | 6/2006 | Duggan et al. | 166/277 |
| 7,066,283 | B2 | | 6/2006 | Livingstone | |
| 7,066,284 | B2 | * | 6/2006 | Wylie et al. | 175/65 |
| 7,303,023 | B2 | * | 12/2007 | Harrall et al. | 166/384 |
| 7,380,594 | B2 | * | 6/2008 | Benzie et al. | 166/207 |
| 7,422,071 | B2 | * | 9/2008 | Wilkie et al. | 166/387 |
| 7,665,537 | B2 | * | 2/2010 | Patel et al. | 166/387 |
| 2003/0075342 | A1 | | 4/2003 | Gunnarsson | |
| 2004/0020662 | A1 | | 2/2004 | Freyer | |
| 2004/0055760 | A1 | * | 3/2004 | Nguyen | 166/387 |
| 2004/0194971 | A1 | | 10/2004 | Thomson | |
| 2005/0072579 | A1 | | 4/2005 | Gambier | |
| 2009/0120640 | A1 | * | 5/2009 | Kulakofsky et al. | 166/277 |

FOREIGN PATENT DOCUMENTS

| | | | | |
|---|---|---|---|---|
| JP | 9317369 | | | 12/1997 |
| WO | 9945233 | | | 9/1999 |
| WO | 03008756 | A1 | | 1/2003 |
| WO | WO03/008756 | | * | 1/2003 |
| WO | 2004067906 | A1 | | 8/2004 |
| WO | WO 2004/067906 | | * | 8/2004 |
| WO | 2005116394 | | | 8/2005 |
| WO | 2006065144 | A1 | | 6/2006 |

OTHER PUBLICATIONS

English language abstract for JP 9317369.
International Search Report for International Application No. PCT/NO2005/000456, dated Mar. 30, 2006.
Search Report for Norwegian Application No. 20045478, dated Aug. 1, 2005.
Examiner's first report issued Mar. 16, 2009, by IP Australia for Australian Patent Application Serial No. 2005317308, 2 pages.
GCC Search Report issued Jun. 3, 2009, for GCC Patent Application Serial No. GCC/P/2005/5517, 6 pages.
MX Official Action issued Jun. 8, 2009, for MX Patent Application Serial No. MX/a/2007/007284, 4 pages.
Office Action issued Dec. 25, 2009, for Chinese Patent Application Serial No. 200580043235.8, 6 pages.
Search Opinion issued Jul. 28, 2010, for EP Patent Application No. 05817486.3, 2 pages.
Search Report issued Jul. 28, 2010, for EP Patent Application No. 05817486.3, 2 pages.
Office Action issued Oct. 18, 2010, for MX Patent Application No. MX/a/2007/007284, 3 pages.

* cited by examiner

I–I

II–II

METHOD AND DEVICE FOR SEALING A VOID INCOMPLETELY FILLED WITH A CAST MATERIAL

CROSS-REFERENCE TO RELATED APPLICATIONS

The present application is a U.S. national stage commencement under 35 USC 371 of prior International Application No. PCT/NO2005/000456, filed Dec. 12, 2005, which claims the benefit of the filing date of Norway Patent Application No. 20045478, filed Dec. 16, 2004. The entire disclosures of these prior applications are incorporated herein by this reference.

BACKGROUND

This invention relates generally to equipment utilized and operations performed in conjunction with a subterranean well. More particularly, a method for sealing a void incompletely filled with a cast material comprises the placing of an expandable material in the void which is to be filled with cast material, the expandable material expanding into spaces which are not filled with cast material. The method is particularly suitable for sealing openings in an annulus round a cast-in casing as it is known from the recovery of petroleum. The invention also comprises a device for practicing the invention.

When cementing an annulus between a casing and a formation wall in a borehole, especially when approximately horizontal boreholes are involved, it can be very difficult or impossible to achieve complete filling of the annulus with a cast material.

One reason for this condition is essentially that a fluid present on an underside of the casing is difficult to drain completely. This fluid may include drilling fluid.

Fluid present in the annulus during the curing of the cast material, and in particular fluid present in the lower portion of the annulus, could form a channel along the borehole, which may extend so far that it connects different zones of the borehole.

It is obvious that channels of this kind are undesirable as an uncontrollable fluid transport may occur in the channel. For example, formation water from a zone may flow into a nearby petroleum-producing zone.

It is known to use an expandable material to shut off an annulus. For example, Norwegian Patent No. 312478 discloses a packer which is made using a swellable material. After the packer has been placed at a desired location, the material of the packer absorbs a fluid and thereby swells until it seals the annulus.

SUMMARY

In carrying out the principles of the present invention, methods and devices are provided which remedy or reduce at least one of the drawbacks of the prior art.

In one example, sealing of a void which is incompletely filled with a cast material is realized by placing an expandable material in the void which is to be filled with cast material. The expandable material then expands into spaces which are not filled with cast material after the cast material has cured, typically by displacing a fluid.

When, for example, a casing is to be cemented in a borehole, at least one sleeve-shaped plug is placed so that it encircles the casing, before the casing is run into the borehole.

When the casing is run to its predetermined position in the borehole, the annulus encircling the casing is filled with drilling fluid. The expandable material attempts, to a certain degree, to centralize the casing in the borehole.

When a cast material, normally in the form of concrete, then flows into the annulus, the fluid present in the annulus is substantially displaced as the volume fills with concrete.

It has turned out to be difficult, however, to displace all of the fluid out of the annulus. For example, some fluid accumulates at the bottom of the annulus. After casting, the sleeve-shaped plug of expandable material may be disposed partly in this fluid and partly embedded in the cast material.

The expandable material will expand, for example, due to swelling on contact with the fluid, or by diffusion of the fluid into openings in the expandable material. Adjacent fluid is displaced by the expandable material, which thereby has the effect that, for example, a fluid channel in the lower portion of the annulus is shut off.

The expandable material may be formed, for example, using a swellable material which may be a foam-like diffusible material which is compressed before being placed in the borehole, cavities in the material filling up with fluid over time, whereby the material expands. The expandable material may be designed to expand on contact with, for example, water, oil, gas or other suitable materials.

A swellable material may be selected, for example, from a group including an elastic polymer such as EPDM rubber, styrene/butadiene, natural rubber, ethylene/propylene monomer rubber, styrene/propylene/diene monomer rubber, ethylene/vinyl acetate rubber, hydrogenated acrylonitrile/butadiene rubber, acrylonitrile/butadiene rubber, isoprene rubber, chloroprene rubber or polynorbornene. The swellable material may further include mixtures of the mentioned materials, possibly with the addition of other dissolved or mixed-in materials, such as cellulose fibre, as it is described in U.S. Pat. No. 4,240,800. Further alternatives may include a rubber in a mechanical mixture with polyvinyl chloride, methyl methacrylate, acrylonitrile, ethyl acetate, or other polymers which will expand on contact with oil.

A diffusible material can be selected from a group including nitrile rubber. As mentioned above, the diffusible material is made of an elastic material with a considerable portion of closed cavities, the material allowing the diffusion of a fluid through the material into the cavities.

The expandable materials may be provided with one or more reinforcements, for example, in the form of a fibre cloth.

In one aspect of the invention, a method of sealing an annulus in a borehole includes the steps of: positioning an expandable material on a tubular structure; installing the tubular structure in the borehole, the annulus being formed between the tubular structure and the borehole; flowing a castable material into the annulus, the castable material partially displacing a fluid in the annulus, but leaving at least one space containing the fluid in the annulus; and expanding the expandable material into the space.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
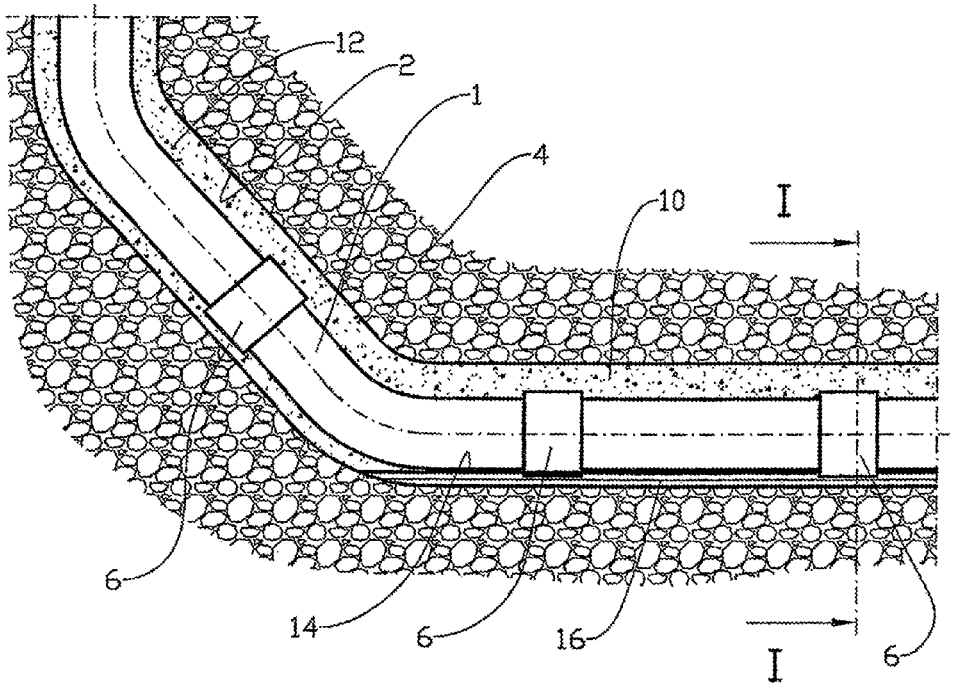
FIG. 1 is a schematic partially cross-sectional view of a well system which embodies principles of the present invention.
Figure 2:
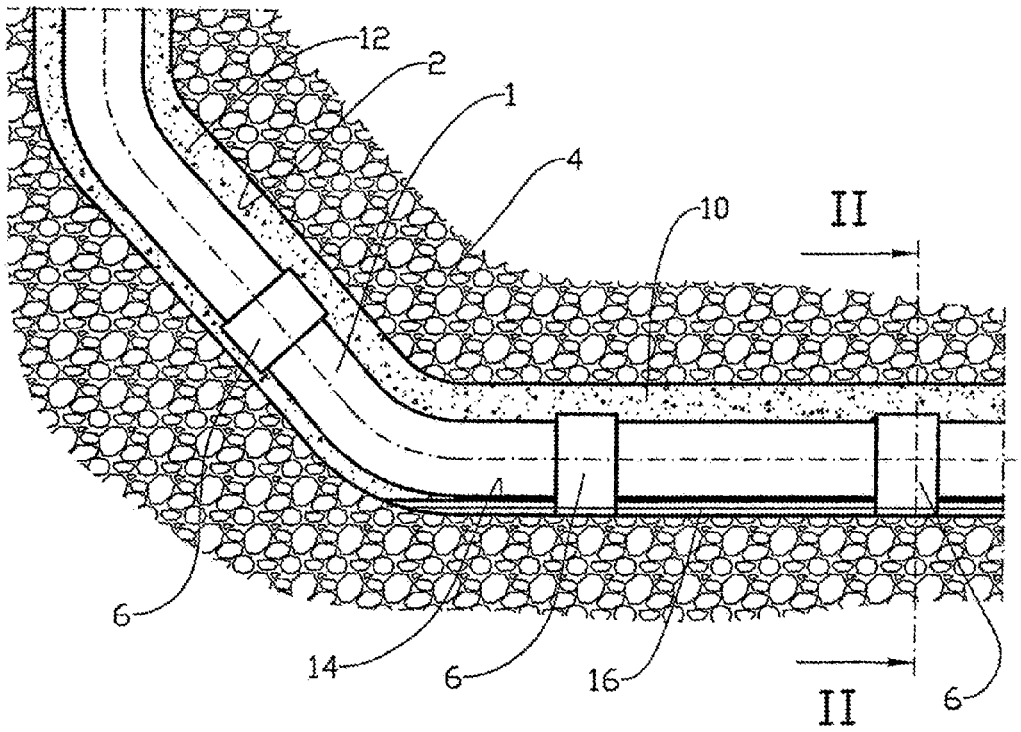
FIG. 2 is a schematic partially cross-sectional view of the well system of FIG. 1, in which a swellable material has filled a void left in a cast material.
Figure 3:
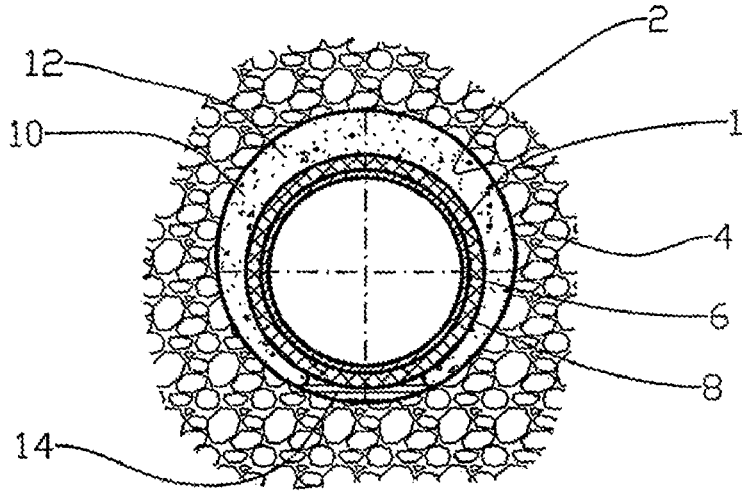
FIG. 3 is a schematic cross-sectional view of the well system, taken along line I-I of FIG. 1.
Figure 4:
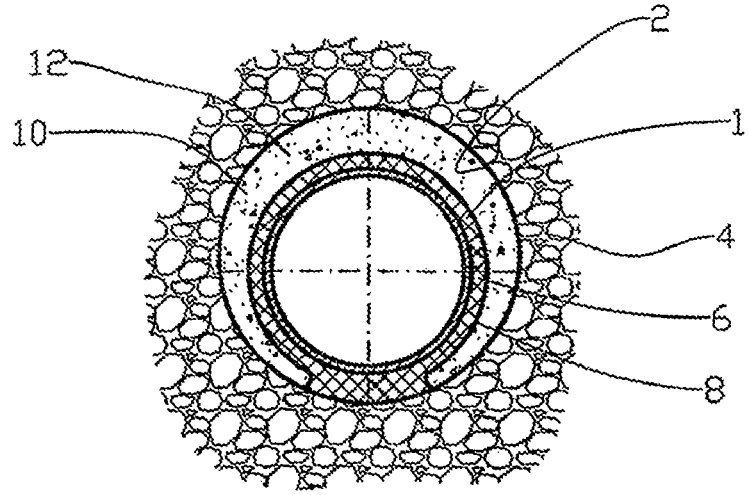
FIG. 4 is a schematic cross-sectional view of the well system, taken along line II-II of FIG. 2.

FIG. 1 shows a well system in which casing or another tubular structure is provided with sleeves of an expandable material, and which is placed in an approximately horizontal borehole in the ground, castable material having been filled into the annulus between the casing and the borehole wall. FIG. 2 shows the same as FIG. 1 after some time has passed, the expandable material having sealed an opening in the cast material. FIG. 3 shows a section I-I of FIG. 1. FIG. 4 shows a section II-II of FIG. 2.

In the drawings the reference numeral 1 identifies a casing which is located in a borehole 2 of a formation 4.

The casing 1 is encircled by several sleeves 6 made of an expandable material.

The sleeves 6 are fitted to the casing 1 before the casing is run into the borehole 2, and the sleeves 6 thereby help the casing 1 not to be laid down completely on the bottom of the borehole 2.

Most advantageously, the sleeve 6 is provided with an externally penetrable, preferably durable, cloth material 8. This material may also contain reinforcement in the form of metal bodies or synthetic fibre. The penetrable cloth material 8 inhibits the expandability of the sleeve 6 only to an insignificant degree.

After the casing 1 has been placed in the borehole 2, castable material 10, here concrete, is filled into a void 12 in the form of an annulus between the casing 1 and the borehole 2, see FIG. 1.

As appears from FIGS. 1 and 3, the annulus 12 is not completely filled with cast material 10, as some drilling fluid 14 is present in the lower portion of the annulus 12.

This drilling fluid 14 which has not been displaced by the cast material 10, has the effect that a flow-permitting channel 16 is formed along the borehole 2.

After some time the expandable material of the sleeve 6 has expanded, through the influence of the drilling fluid 14, for example, and displaced the drilling fluid 14 present between the sleeve 6 and the borehole 2, see FIGS. 2 and 4. The expandable material of the sleeve 6 now abuts the wall of the borehole 2, thereby sealing the longitudinal channel 16 to fluid flow.

Thus has been described a method for sealing a void 12 incompletely filled with a cast material 10, in which an expandable material 6 is placed in the void 12 which is to be filled with a cast material 10, the expandable material 6 expanding, after the cast material 10 has cured, into spaces 16 which are not filled with cast material 10. The expandable material in the form of a sleeve 6 is connected in an encircling manner to a pipe 1 before the pipe 1 is run into a borehole 2. The expanding material 6 is at least partially enveloped in a cast material 10.

Also disclosed is a device for sealing a void 12 incompletely filled with a cast material 10, in which, before casting, an expandable material 6 is placed in the void 12, the expandable material 6 being arranged to expand into spaces 16 which are not filled with cast material 10. The expandable material 6 is formed by a sleeve encircling a pipe 1. The pipe 1 is located in a borehole 2.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention.

Accordingly, the foregoing detailed description is to be clearly understood as being given by way of illustration and example only, the spirit and scope of the present invention being limited solely by the appended claims and their equivalents.

What is claimed is:

1. A well system, comprising:

a device which expands into a space in a borehole, the space being at least partly defined by a castable material disposed radially between and in contact with the borehole and the device, wherein the device comprises an annular element disposed on a tubular structure in the borehole and including an expandable material which extends from a retracted state to an expanded state in response to contact with a fluid in the well system.

2. The system of claim 1, wherein the space is at least partly defined by a wall of the borehole.

3. The system of claim 1, wherein the space is at least partly defined by the tubular structure.

4. The system of claim 1, wherein the space at least partly holds the fluid.

5. The system of claim 1, wherein the fluid is disposed at least partially in the space, and wherein the expandable material extends from the retracted state to the expanded state in reaction to exposure to the fluid in the space.

6. The system of claim 1, wherein the castable material comprises hardened concrete.

7. The system of claim 1, wherein the space comprises an elongated channel defined by at least the castable material, the tubular structure and the borehole wall.

8. A method of sealing a space in a borehole, the space being at least partly defined by a castable material disposed in the borehole, the method comprising the steps of:

disposing on a tubular structure at least one annular element comprising an expandable material capable of extending from a retracted state to an expanded state;

installing the tubular structure in the borehole;

then providing the castable material into a volume defined by a wall of the borehole and an outer surface of the tubular structure, the castable material extending at least partially circumferentially about the annular element; and extending the expandable material into contact with the wall of the borehole.

9. The method of claim 8, wherein the disposing step further comprises disposing a plurality of the annular elements at spaced intervals along a length of the tubular structure.

10. The method of claim 8, wherein the expandable material is adapted to extend from the retracted state to the expanded state as a reaction to exposure to a fluid in the space.

11. The method of claim 8, wherein the expandable material extends into the space after the castable material has hardened.

12. The method of claim 8, wherein the space comprises an elongated channel defined by at least the castable material, the tubular structure and the borehole wall.

13. A method of sealing an annulus in a borehole, the method comprising the steps of:

positioning an expandable material on a tubular structure;

installing the tubular structure in the borehole, the annulus being formed between the tubular structure and the borehole;

then flowing a castable material into the annulus, the castable material partially displacing a fluid in the annulus, and the castable material being disposed radially between the expandable material and the borehole, but leaving at least one space containing the fluid in the annulus; and expanding the expandable material into the space in response to contact between the expandable material and the fluid.

14. The method of claim 13, wherein the positioning step further comprises positioning a plurality of sleeves on the tubular structure, each of the sleeves including the expandable material.

15. The method of claim 13, wherein the expanding step is performed in reaction to exposure of the expandable material to the fluid.

16. The method of claim 13, wherein the expanding step is performed at least partially after the castable material has hardened in the annulus.

17. The method of claim 13, wherein the flowing step further comprises leaving the space so that the space is bounded at least partially by the castable material.

18. The method of claim 13, wherein the flowing step further comprises leaving the space so that the space is bounded at least partially by the borehole.

19. The method of claim 13, wherein in the positioning step the expandable material comprises a swellable material.

20. The method of claim 13, wherein the flowing step further comprises contacting a portion of the expandable material with the castable material, and contacting another portion of the expandable material with the fluid in the space.

* * * * *